United States Patent [19]

Seitzer et al.

[11] 4,231,858

[45] Nov. 4, 1980

[54] PROCESSING SHALE OIL TO JET FUEL

[75] Inventors: Walter H. Seitzer, West Chester; Abraham Schneider, Overbrook Hills, both of Pa.

[73] Assignee: Suntech, Inc., Philadelphia, Pa.

[21] Appl. No.: 916,027

[22] Filed: Jun. 15, 1978

Related U.S. Application Data

[63] Continuation-in-part of Ser. No. 766,113, Feb. 7, 1977, abandoned.

[51] Int. Cl.[2] ..... C10G 23/02; C10G 29/12

[52] U.S. Cl. ..... 208/89; 208/254 R; 208/254 H

[58] Field of Search ..... 208/212, 254 R, 254 H, 208/89, 90

[56] References Cited

U.S. PATENT DOCUMENTS

| | | | |
|---|---|---|---|
| 2,966,450 | 12/1960 | Kimberlin, Jr. et al. | 208/90 |
| 3,085,061 | 4/1963 | Metrailer | 208/281 |
| 3,345,286 | 10/1967 | Kovach et al. | 208/254 H |
| 3,383,305 | 5/1968 | Rogers et al. | 208/254 H |

*Primary Examiner*—George Crasanakis
*Attorney, Agent, or Firm*—J. Edward Hess; Donald R. Johnson; Anthony Potts, Jr.

[57] ABSTRACT

Whole crude shale oil is contacted with a suitable catalyst, e.g., cobalt molybdate on alumina, and hydrogen within a temperature range of about 600° F.–850° F. and a pressure range of about 200 psig–5000 psig until a substantial amount of nitrogen compounds contained in the oil are converted to at least basic nitrogen compounds. Hydrogen consumption is high, about 700–3000 SCF/Bbl of fresh oil charged. The contacted oil, containing basic nitrogen compounds in the oil, formed by the hydrogen contacting, is reacted with dry HCl and resulting reaction product is removed from the oil. The reaction product can be converted into hydrogen and HCl for use in the process. As a result of the severe hydrogen contacting and the HCl treatment, a major amount of the whole crude shale oil can be converted to jet fuel.

11 Claims, 1 Drawing Figure

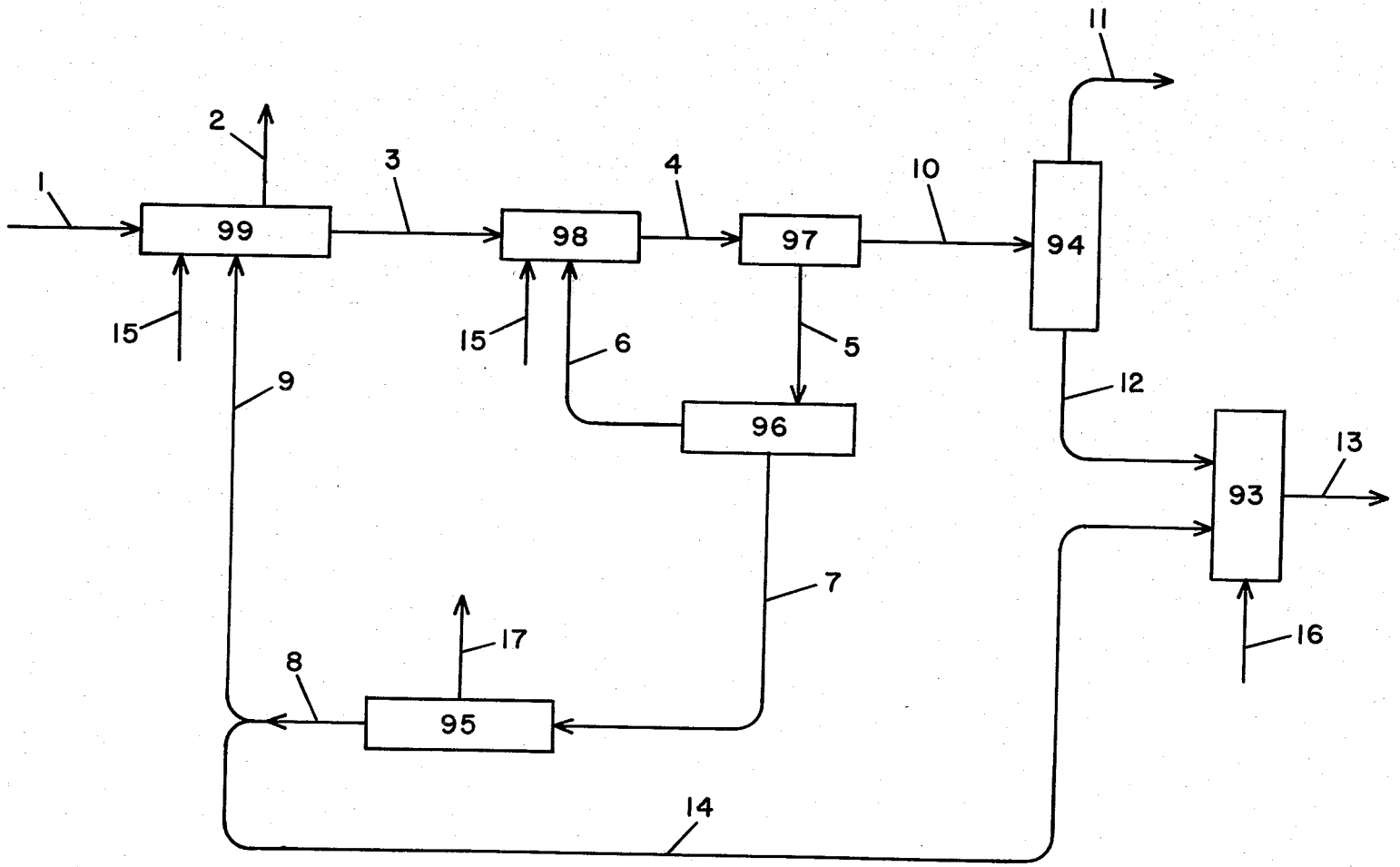
1
2
3
4
5
6
7
8
9
10
11
12
13
14
15
15
16
17
99
98
97
96
95
94
93

PROCESSING SHALE OIL TO JET FUEL

CROSS REFERENCE TO RELATED APPLICATION

This application is a continuation-in-part of U.S. patent application Ser. No. 766,113, filed Feb. 7, 1977, now abandoned by the above identified applicants.

BACKGROUND OF THE INVENTION

The present invention relates to processing of whole crude shale oil. It relates to the processing whole crude shale oil so as to obtain a maximum amount of jet fuel from a given amount of the oil. It involves the conversion of nitrogen compounds in the whole crude shale oil to basic nitrogen compounds which then can be treated with hydrogen-chloride and the resulting reaction product can be easily separated from the oil. Such a process insures an adequate supply of jet fuel for U.S. military use because of known reserves of recoverable shale oil indigenous to the United States.

Shale oil cannot be satisfactorily processed by standard petroleum processing techniques primarily because of its high nitrogen content, amounting to between about 1.4–2.5 wt. %. As a result, conventional processing techniques result in final fuel products which are unstable in storage. Excessive residual nitrogen in the fuel products is believed to be the cause of the aforementioned instability. As discussed hereinafter several techniques have been attempted to solve the nitrogen problem.

DESCRIPTION OF THE PRIOR ART

U.S. Pat. No. 3,085,061 discloses mildly treating a distillate fraction of a shale oil, which has been thermally cracked in a fluid coker, in a vapor phase with hydrogen at a low pressure, i.e., 50 to 175 psig and with a consumption of about 500 SCF/bbl. In this first stage, the nitrogen content is only reduced slightly, from 5 to 50% of its original value. Afterwards, the mildly treated oil is contacted with anhydrous hydrogen chloride to form a sludge containing substantially all the nitrogen. The resulting hydrocarbon product has catalytic cracking characteristics essentially equivalent to a product prepared from a petroleum crude oil.

U.S. Pat. No. 3,345,286 discloses that the addition of cerium or thorium to cobalt-molybdenum catalyst or cobalt-tungsten on an inorganic oxide catalyst causes an increase in the catalysts' hydrogenation-denitrogenation activities. It further discloses the mild hydrogen treatment of particular shale oil fractions using a nickel molybdena-alumina catalyst in order to hydrogenate and denitrify the fractions.

U.S. Pat. No. 2,966,450 discloses the treatment of untreated whole crude shale oil with anhydrous HCl. But despite the HCl treatment a substantial amount of nitrogen still remains. Also disclosed is the use of a paraffinic solvent to enhance the removal of nitrogen compounds.

SUMMARY

In contrast to the mild hydrogen treatment of a shale oil fraction which was obtained from a fluid coker or an untreated whole shale oil, and the mild treatment of untreated whole shale oil with HCl disclosed in the aforementioned patents, present invention, in part, is a severe treatment of whole crude shale oil with hydrogen. Unexpectedly, the severe treatment of the oil facilitates obtaining a major amount of jet fuel from crude shale oil.

In present invention whole crude shale oil is treated with hydrogen (consumption is about 700 to 3000 standard cubic feet per barrel of fresh oil charged) at a pressure up to 5000 psig and at a temperature in the range of 600° F.–850° F. As a result, a substantial amount of the non-basic nitrogen compounds contained in the oil are converted to basic nitrogen compounds. The basic nitrogen compounds are reacted with dry hydrogen chloride (HCl) and the reaction product is removed from the oil.

The reaction product of the nitrogen compounds and the hydrogen chloride can be processed to obtain both HCl, which can be recycled, and hydrogen for treatment of the shale oil. The amount of hydrogen can be sufficient so as to satisfy the needs of subsequent processing of the treated shale oil.

DESCRIPTION OF THE DRAWING

The accompanying drawing schematically illustrates one embodiment of carrying out the conversion of raw shale oil to jet fuel according to the invention.

DESCRIPTION OF THE INVENTION

One embodiment of the invention is hereinafter described in connection with the drawing.

The liquid feed (1), consisting essentially of whole crude shale oil, is fed to contacting means (99). Means 99 contains a suitable hydrogen treating catalyst, e.g., cobalt molybdate on alumina. Also fed to means (99) is recycled hydrogen (9), or/and fresh hydrogen (15). The contacting occurs at an elevated temperature, e.g., 750° F. and at an elevated pressure, e.g., 2500 psig. The feed (1) can be heated by various means such as exchanging heat with hot products, and the temperature of the contacting can be maintained by various heating means such as a heater and heat exchangers, both not shown. The contacting conditions are such that some of the nitrogen compounds are converted to hydrocarbons and ammonia and any remaining nitrogen compounds are basic nitrogen compounds which will react with HCl. In addition, the conditions can be such that a substantial portion of any other nonhydrocarbons, such as those containing oxygen and sulfur, are converted to hydrocarbons. As to the basic nitrogen compounds, it is believed that they are amines. Essentially no cracking of carbon-to-carbon bonds occurs under the aforementioned conditions. Off gas (2) from means (99) can be collected and used for various processes. The off gas can consist of methane, $C_2$'s, $C_3$'s, $C_4$'s, $NH_3$, $H_2O$, $H_2S$ and other similar materials.

The separated liquid hydrogenated hydrocarbon product (3), which does not contain the aforementioned catalyst, from means (99) is fed to HCl treating means (98). Also fed to means 98 is HCl, either recycle (6) or makeup (15) or a combination of both. The HCl treatment within means (98) can consist of passing dry HCl through the liquid hydrogenated hydrocarbon and can include agitation by various means, not shown. The HCl treatment can consist of one stage or several stages. The HCl reacts with the basic nitrogen compounds contained in the hydrogenated hydrocarbon product to form a precipitate. It is believed that the latter are various insoluble aminehydrochlorides. The HCl treated hydrocarbon product (4) is fed to separation means (97) which separates, e.g., by decantation or centrifuging, the precipitate from the liquid. Means 97 and 98 can be a mixer-setter of conventional design provided, if desired, with agitation and heating means. The temperature prevailing within means 97 and 98 must be controlled. The desired temperature range is between two limits. If the temperature is too high the resulting reaction product from the reaction of the HCl and the basic nitrogen compounds will redissolve in the oil. If the temperature is too low, wax will precipitate. In general, it is convenient to maintain the temperature within the limits of about 90° F. (32° C.) to about 130° F. (82° C.).

The liquid hydrocarbon product (10) from separation means (97), now having a low concentration of basic nitrogen materials is treated to remove the remaining nitrogen materials. The final nitrogen removal can be obtained by treating with 80 to 90 wt. % sulfuric acid (not shown) or with clay (not shown). The liquid hydrocarbon product can be further treated with caustic to remove any residual HCl. Such neutralizing means are not shown. Hydrocarbon product (10) is fed to distillation means (94) wherein a jet fuel product (11) is taken. The balance of the hydrocarbon (12) is fed to hydrocracker (93) from which numerous boiling range hydrocarbons (13) are obtained, including a large amount of jet fuel.

Stream (5), consisting of the separated amine-hydrochloride material, is fed to decomposing means (96). Decomposing means (96), for example by heating to a decomposition temperature of above 400° F., decomposes the amine-hydrochloride material into gaseous HCl which is separated and returned as recycle (6) to HCl treating means (98). The other product (7) from decomposing means (96) is fed to hydrogen producing means (95). Hydrogen producing means (95), via partial oxidation for example, converts the amines to hydrogen (8) which can be recycled (9) to means (99), or fed as a stream (14) to the hydrocracker (93). In hydrocracker (93), carbon-to-carbon breaking does occur. Makeup hydrogen (16) can also be fed to hydrocracker (93). Off gas (17) is produced by means (95) and consists, if partial oxidation is used, of carbon dioxide, steam, and other impurities such as $H_2S$ and $NH_3$.

In addition to the foregoing, present invention also is an improvement to the process for preparing whole crude shale oil for maximum conversion to jet fuel in which the whole crude shale oil is contacted with both hydrogen and a catalyst selected from the group consisting of cobalt-molybdate on alumina, nicket molybdate on alumina and nickel-cobalt on alumina. The contacting temperature is in the range of between about 600° F. to about 850° F. and is at a pressure in the range of between from about 200 psig to about 5000 psig. The improvement comprises continuing the contacting until a substantial amount of basic, neutral and acidic nitrogen compounds contained in the oil are converted to basic nitrogen compounds, hydrocarbons and ammonia. The improvement further comprises that the contacted shale oil is separated from the catalyst and then the separated oil is contacted with anhydrous hydrogen chloride in an amount at least sufficient to react with a substantial portion of the basic nitrogen compounds contained in the oil. Furthermore, the improvement comprises that the temperature range of the HCl treatment is between a lower temperature at which only nominal amounts of wax will precipitate and an upper temperature at which only nominal amounts of reaction product resulting from the reaction of the hydrogen chloride and the basic nitrogen compounds will redissolve in the oil; and separating the oil contacted with the hydrogen chloride from the reaction product.

It is estimated that the process as heretofore described will produce about 30,000–35,000 B/D of jet fuel from 50,000 B/D of whole crude shale oil feed. It is believed that such a high yield results because the severe contacting with hydrogen breaks off nitrogen, oxygen and sulfur from compounds to give hydrocarbon fragments boiling in the jet fuel range. A prior prediction that the hydrocarbon fragments would be in the jet fuel range is not possible at present. Thus this type of contacting has at least two benefits: (1) high yields of jet fuel with low oxygen and sulfur, and (2) conversion of any remaining nitrogen compounds to basic compounds thereby allowing the hydrogen chloride to remove the basic compounds which results in a relatively clean product.

Whole crude shale oil refers to a liquid material derived from the thermal breakdown of high molecular weight kerogen. The bulk of whole crude shale oil distills below about 1050° F. Such an oil contains, compared to petroleum oils, large amounts of nitrogen, oxygen and sulfur. The latter three are combined with the carbon and hydrogen contained in the oil.

The contacting with hydrogen of present invention has many objectives. Since the whole crude shale oil is prepared by a thermal process unsaturation exists. The contacting saturates the olefinic linkages, thereby avoiding the formation of organic chlorides resulting from the reaction of HCl and the olefinic linkages. Also, the contacting involves hydrodesulfurization. Also with the hydrogen contacting the neutral and acidic nitrogen compounds are changed to basic nitrogen compounds, while basic nitrogen compounds are changed to hydrocarbons and $NH_3$. Hydrodeoxygenation also occurs. Dematallation occurs. The latter is an advantage because metallic contaminants would seriously deactivate catalysts used in subsequent refining of the hydrogen treated shale oil. Also partial hydrogenation of polynuclear aromatics, e.g., naphthalenes to tetralins, take place. Finally, the hydrogen contacting condition as used by the applicants' process does not include breakdown carbon-to-carbon bonds to any significant extent. However, the conversion of substantially all of the neutral and acidic nitrogen compounds remaining in the contacted shale oil to basic nitrogen compounds is critical to the invention.

It is believed that the following simplistic reactions help in understanding the present invention:

(1) RN basic $+ H_2 \xrightarrow{\text{catalyst}}$ RH $+ NH_3$ (2) RN neutral $+ H_2 \xrightarrow{\text{catalyst}}$ RN basic (3) RN acidic $+ H_2 \xrightarrow{\text{catalyst}}$ RN neutral Because of the time of contacting and higher pressure and higher hydrogen consumption, applicants' method continues reactions (2) and (3) until a substantial amount, if not essentially all, of the neutral and acidic nitrogen hydrocarbons are changed (converted) to the basic nitrogen hydrocarbons. It is further believed that the rate of reaction (1) is greater than that of reactions (2) or (3) and unless severe hydrogen contacting occurs, not all the neutral or acidic nitrogens are converted to basic ones. By converting to the basic nitrogen compounds substantially all of the remaining nitrogen compounds can be removed by the subsequent treatment with HCl.

Hydrogen contacting of applicants' process involves the use of a catalyst selected from the group consisting of cobalt molybdate on alumina, nicket molybdate on alumina, or nickel-cobalt molybdate on alumina. The pressure used during the contacting can vary substantially but generally, because of economic considerations, it will range between from a few hundred pounds to many thousands of pounds. Generally, the pressure will range between from about 200 psi to about 500 psi, with 1000 to 3000 psi preferred. The temperature of contacting can also vary but the lower limit depends on the rate of the chemical reactions while the upper limit depends on carbon-carbon cracking. Generally, the temperature will range from between about 600° F. (316° C.) to about 850° F. (454° C.), preferably 700° F. (371° C.) to 825° F. (441° C.). The time required for the contacting depends on the reactor size; the mixing means, if any, mass transfer rates, flow rates and other such variables. Within the foregoing parameters, generally the contacting continues until a substantial amount of nitrogen compounds contained in the oil are either destroyed or converted to basic nitrogen compounds. In addition, the hydrogen contacting can continue until a substantial portion of the other non-hydrocarbons, i.e., the sulfur and oxygen containing compounds contained in the oil are converted to hydrocarbons.

The hydrogen contacting of applicants' process is generally obtained via a vapor-liquid process, examples of which include the use of trickle flow in fixed-bed or slurry contacting of catalyst with shale oil in stirred reactor, or other such techniques. During the contacting in a fixed-bed mode the liquid hourly space velocities will range from between about 0.1 to about 3.0 volumes of shale oil per volume of catalyst per hour with about 0.5 to about 2.0 preferred. Hydrogen consumption during the contacting will range between from about 700 standard cubic feet per barrel (SCF/B) of fresh charge to about 3000 SCF/B with about 1000 to 2500 preferred.

The HCl used is anhydrous. The amount used generally is an amount sufficient to saturate the oil, but lesser amounts can be used. In particular, about 0.25 to about 3.0 equivalents of anhydrous HCl per equivalent of nitrogen in the oil can be used, with about 0.4 to about 1.5 preferred.

The process of the present invention may be further illustrated by the following example and a comparative run.

EXAMPLE

Two runs were performed in an 0.8 liter rocking autoclave. One run illustrates the present invention and the results are reported in accompanying Table I. The other run represents a comparative run at a shorter reaction time and its results are reported in accompanying Table II. In both runs 350 grams of whole crude shale oil were charged to the autoclave which contained 17.5 grams of a cobalt molybdate-on-alumina catalyst and both the oil and catalyst were sulfided under about 400 psig $H_2S$ at 200° C. for 12 hours. The reactor and its contents were then cooled, depressurized and repressurized with hydrogen and heated to 300° C. (572° F.). Then the hydrogen pressure was increased to 2600 psig and the reactor gradually heated to 410° C. (770° F.) over a period of about three hours. Pressure was maintained between 1900 psig and 2600 psig for the duration of the run. Run time, as shown in the Tables, was calculated from the time at which the temperature passed 300° C. (572° F.). Pressures reported in the Tables are an average. At the end of the runs, the reactor was cooled, the contents discharged and filtered. The hydrocarbon product was subsequently treated with HCl as hereinafter described.

Elemental analysis for the whole crude shale oil prior to the runs is shown in both Tables along with an analysis for each of the hydrocarbon products.

The hydrocarbon product was treated with HCl by bubbling dry HCl through the product with high agitation for 5 minutes. The formed HCl precipitate, a comparative viscous liquid was allowed to settle out and separated by decantation. This separated precipitate, after treatment with caustic to release the HCl, is the material referred to as "extracted" in the Tables. The remaining hydrocarbon product (raffinate) was again treated with dry HCl as heretofore described. The second extract was combined with the first.

Both the raffinate and combined extracts were first washed with aqueous sodium hydroxide, then with water, then dried and finally filtered. The sodium hydroxide caused the hydrocarbons and other materials in the extract to be released from the HCl. The elemental analysis of both raffinate and extract are given in the Tables. However, in the invention the HCl precipitate would not be treated with caustic but rather it would be heated to release its HCl and the nitrogen concentrate used to provide the hydrogen required by the hydrogen contacting step. The released HCl would be recycled to the hydrogen chloride treating step.

For the run reported in Table I, the raffinate, after separation of the precipitate, was subjected to centrifugation to facilitate the separation of the HCl precipitate.

The raffinate was distilled into a 510° F. minus fraction and 510° F. plus fraction in a Podbielniak column with 30 plates at 30:1 reflux. The yields are as shown in the Table. Also, an elemental analysis was performed on each. The other materials were distilled in a similar fashion and the boiling points along with yields are given in both Tables.

Comparison of the elemental analysis data reported in Tables I and II provides insight as to what happens to the whole shale oil when it is treated severely as in applicants' process compared to a milder treatment.

In applicants' process the hydrogen content of the whole crude (12.8 wt. %, Table I) is increased substantially compared to that of the mild treatment (11.5 wt. % Table II). Furthermore, both the total nitrogen ($N_T$) and the basic nitrogen ($N_B$) of applicants' product are lower than those obtained in the comparative run. Also, similar reductions occur in the sulfur and oxygen contents of applicants' product.

Of particular significance is the discovery that the yield of the raffinate after HCl treatment by present invention (Table I) is a high 83 wt. % compared to a low 65 wt. % for the mild treatment (Table II). Also of particular significance is the discovery that applicants' hydrogenated product after HCl treatment and distillation contains considerably more of a jet fuel (510° F. minus) fraction, i.e., 42.5 wt. % that the similar fraction obtained in the comparative run i.e., 26 wt. % by a mild treatment.

Also of interest is the nitrogen content of the 510° F.+ distilled raffinate. The total nitrogen level of applicants' product is 0.13 wt. % (Table I) whereas in the comparative run it is 0.37 wt. % (Table II). It is believed that the former can be processed easily by a two stage hydrocracker whereas the latter could not be because of the catalyst poisoning caused by the higher nitrogen content.

Computer refinery simulation of a hydrocracker suggests that applicants' 510° F.+ distilled raffinate would make a large amount of jet fuel.

Other catalysts such as nickel-cobalt molybdate on alumina, can be used in present invention as well as other temperatures and pressures and similar results will be obtained.

TABLE I

Present Invention
Severe Hydrogen Treatment of Whole Crude Shale Oil and HCl Treatment of Product
Wt. % (Unless Otherwise Stated)

| Analysis[a] | Whole Crude Oil | After Hydrogen Treatment[b] | After HCl[c] Raffinate | After HCl[c] Extracted | Distilled Raffinate 510° F.− | Distilled Raffinate 510° F.+ |
|---|---|---|---|---|---|---|
| H | 10.8 | 12.8 | 12.7 | 10.3 | 13.7 | 13.1 |
| $N_T$ | 2.15 | 0.56 | 0.05 | 3.08 | 0.05 | 0.13 |
| $N_B$ | 1.37 | 0.47 | 52ppm | 2.31 | 63ppm | 604ppm |
| S | 0.4 | 0.06 | — | — | — | 240ppm |
| O | 1.2 | 0.09 | — | 0.5 | 0.2 | 0.2 |
| Yield, wt. % | — | 100 | 83 | 15 | 42.5 | 57.5 |
| Density | 0.927 | 0.838 | 0.832 | 0.808 | 0.795 | 0.860 |
| Boiling Point °F. | | | | | | |
| 5% | 475 | 267 | 273 | 435 | 233 | 529 |
| 50% | 789 | 573 | 559 | 714 | 414 | 685 |
| 95% | 1030 | 895 | 880 | 1001 | 509 | 936 |

[a]H = hydrogen, $N_T$ = total nitrogen, $N_B$ = basic nitrogen, S = sulfur, O = oxygen.
[b]12 hours in rocker bomb, temperature 300–410° C., average pressure 2400 psig, hydrogen consumption 1500 SCF/Bbl.
[c]Amount of HCl absorbed was 0.7 weight %.

TABLE II

Comparative Run
Mild Hydrogen Treatment and HCl Treatment of Product
Wt. % (Unless otherwise stated)

| Analysis[a] | Whole Crude Oil | After Hydrogen Treatment[b] | After HCl[c] Raffinate | After HCl[c] Extracted | Distilled Raffinate 510° F.− | Distilled Raffinate 510° F.+ |
|---|---|---|---|---|---|---|
| H | 10.8 | 11.5 | 12.4 | 11.2 | 13.3 | 12.7 |
| $N_T$ | 2.15 | 1.10 | 0.24 | 2.23 | 0.05 | 0.37 |
| $N_B$ | 1.37 | 0.93 | 0.19 | 1.85 | 175ppm | 0.25 |
| S | 0.4 | 0.1 | 0.1 | 0.06 | — | 620ppm |
| O | 1.2 | 0.3 | — | 0.5 | 0.1 | 0.3 |
| Yield, wt. % | — | 100 | 65 | 35 | 26.0 | 74.0 |
| Density | 0.927 | 0.871 | 0.855 | 0.910 | 0.800 | 0.878 |
| Boiling Point °F. | | | | | | |
| 5% | 475 | 331 | 338 | 404 | 249 | 552 |
| 50% | 789 | 677 | 661 | 725 | 430 | 745 |
| 95% | 1030 | 996 | 945 | 1017 | 510 | 1004 |

[a](as in Table I)
[b]6 hours in an autoclave, temperature 300–410° C., average pressure 2400 psig, hydrogen consumption 700 SCF/Bbl.
[c]Amount of HCl absorbed was 2.0 wt. %.

The invention claimed is:

1. Process for preparing whole crude shale oil to facilitate maximum conversion to jet fuel comprising:

(a) contacting whole crude shale oil with both hydrogen and a catalyst selected from the group consisting of cobalt molybdate on alumina, nickel molybdate on alumina and nickel-cobalt molybdate on alumina, at a temperature in the range of between from about 600° F. to about 850° F. and a pressure in the range of between from about 200 psig to about 5000 psig, the combination of conditions being such that the hydrogen consumption is in the range from about 700 to about 3000 standard cubic feet per barrel, until a substantial amount of neutral and acidic nitrogen compounds contained in the oil are converted to basic nitrogen compounds, hydrocarbons and ammonia;

(b) separating the contacted shale oil from the catalyst;

(c) contacting the separated oil with an amount of anhydrous hydrogen chloride at least sufficient to react with the basic nitrogen compounds remaining in said separated oil to form a reaction product, said contacting being carried out at a temperature range wherein the lower temperature is that at which only nominal amounts of wax will precipitate and the upper temperature is that at which only nominal amounts of reaction product resulting from the reaction of the hydrogen chloride and the basic nitrogen compounds will redissolve in the oil; and (d) separating the oil from the reaction product of step (c).

2. Process according to claim 1 wherein the contacting includes liquid hourly space velocities in the range of between from about 0.5 to about 3.0.

3. Process according to claim 2 wherein said contacting with the hydrogen and the catalyst converts a substantial portion of the sulfur and oxygen-containing compounds contained in the oil to hydrocarbons.

4. Process according to claim 1 wherein the reaction product of the hydrogen chloride and the basic nitrogen compounds of step (c) is decomposed by heating into hydrogen chloride and a nitrogen-rich hydrocarbon product.

5. Process according to claim 4 wherein the nitrogen rich hydrocarbon product is converted into hydrogen.

6. Process according to claim 5 wherein the converted hydrogen is used in step (a) of claim 1.

7. Process according to claim 6 wherein the hydrogen chloride is used in step (c) of claim 1.

8. Process according to claim 1 wherein the separated shale oil from step (d) is separated into a jet fuel fraction and at least one other fraction.

9. Process according to claim 8 wherein said at least one other fraction is hydrocracked in the presence of hydrogen obtained from conversion of a nitrogen-rich hydrocarbon product into hydrogen, said nitrogen-rich hydrocarbon product resulting from thermal decomposition of the separated reaction product of step (c).

10. Process according to claim 9 wherein product from the hydrocracking is separated into jet fuel and other fractions.

11. In the process for preparing whole crude shale oil for maximum conversion to jet fuel in which the whole crude shale oil is contacted with both hydrogen and a catalyst selected from the group consisting of cobalt molybdate on alumina, nickel molybdate on alumina and nickel-cobalt on alumina and the contacting is at a temperature in the range of between about 600° F. to about 850° F. and is at a pressure in the range of between from about 200 psig to about 5000 psig wherein the improvement comprises that the combination of conditions being such that the hydrogen consumption is in the range of about 700 to about 3000 standard cubic feet per barrel, and continuing the contacting until a substantial amount of neutral and acidic nitrogen compounds contained in the oil are converted to basic nitrogen compounds, hydrocarbons and ammonia; separating contacting shale oil from the catalyst; contacting the separated oil with anhydrous hydrogen chloride in an amount at least sufficient to react with the basic nitrogen compounds remaining in said separated oil to form a reaction product, said contacting being carried out at a temperature range wherein the lower temperature is that at which only nominal amounts of wax will precipitate and the upper temperature is that at which only nominal amounts of reaction product resulting from the reaction of the hydrogen chloride and the basic nitrogen compounds will redissolve in the oil; and separating the oil from the reaction product.

* * * * *